US005972170A

United States Patent [19]

Hund et al.

[11] Patent Number: 5,972,170

[45] Date of Patent: Oct. 26, 1999

[54] SUCTION BOX

[75] Inventors: Erwin Hund, Schlier; Peter Kahl, Gerstetten; Andreas Meschenmoser, Horgenzell, all of Germany

[73] Assignee: Voith Sulzer Papiermaschinen GmbH, Heidenheim, Germany

[21] Appl. No.: 08/961,990

[22] Filed: Oct. 31, 1997

[30] Foreign Application Priority Data

Oct. 31, 1996 [DE] Germany ..... 196 44 110

[51] Int. Cl.[6] ..... D21F 3/00

[52] U.S. Cl. ..... 162/358.1; 162/360.2; 162/374

[58] Field of Search ..... 162/374, 358.1, 162/360.2, 363, 193, 306, 307; 34/117

[56] References Cited

U.S. PATENT DOCUMENTS

| | | | |
|---|---|---|---|
| 4,526,655 | 7/1985 | Karvinen et al. | 162/360.2 |
| 4,551,203 | 11/1985 | Eskelinen | 162/306 |
| 4,628,618 | 12/1986 | Virta et al. | 34/116 |
| 4,698,919 | 10/1987 | Wedel . | |
| 5,019,213 | 5/1991 | Virta et al. | 162/193 |
| 5,238,535 | 8/1993 | Kraft | 162/306 |
| 5,503,716 | 4/1996 | Kivimaa et al. | 162/193 |
| 5,833,810 | 11/1998 | Laapotti . | |

FOREIGN PATENT DOCUMENTS

| | | | |
|---|---|---|---|
| 0254666 | 1/1988 | European Pat. Off. . | |
| 400843 | 12/1990 | European Pat. Off. | 162/358.2 |
| 0657579 | 6/1995 | European Pat. Off. . | |
| 3504820 | 9/1985 | Germany . | |

*Primary Examiner*—Karen M. Hastings
*Attorney, Agent, or Firm*—Greenblum & Bernstein, P.L.C.

[57] ABSTRACT

A suction box for use in a press arrangement in a machine for producing a paper or cardboard web. The suction box includes at least one suction side suctioning the fibrous pulp sheet onto a transport side of at least one felt belt. The suction box further includes at least one non-suction side and at least one slit. A vacuum is created by having air blown out of at least one slit. The vacuum occurs along the felt belt in a run direction of the felt belt. The slit is positioned at an edge of at least one non-suction side of the suction box. The suction box may be disposed on an exit side of a press slit of the press arrangement. The press slit is adapted to treat the fibrous pulp sheet. At least one felt belt is guided, simultaneously with the fibrous pulp sheet, through the press slit. Upon exiting the press slit, the fibrous pulp sheet is suctioned onto at least one felt belt by the suction box.

30 Claims, 2 Drawing Sheets

SUCTION BOX

CROSS-REFERENCE TO RELATED APPLICATION

The present application claims priority under 35 U.S.C. §119 of German Patent Application No. 196 44 110.2 filed Oct. 31, 1996, the disclosure of which is expressly incorporated by reference herein in its entirety.

BACKGROUND OF THE INVENTION

1. Field of the Invention

The invention relates to a suction box for a press arrangement of a machine for producing a paper or cardboard web.

2. Background of the Invention

The present invention includes a press arrangement for a machine for producing a paper or cardboard web. The press arrangement includes a press slit through which a fibrous pulp sheet is treated and through which at least one felt belt is guided. As the fibrous pulp sheet exits the press slit, it runs concurrently with the felt belt.

In such press arrangements, depending on the running speed and the condition of the felt, a more or less strong, undesirable lifting of the fibrous pulp sheet from the respective felt belt can occur in the area of the press slit outlet. In addition, during start-up, a sheet run-up can occur which is problematic.

SUMMARY OF THE INVENTION

The goal of the present invention is to create a suction box and a press arrangement of the type described above which ensures that the problems named are eliminated and, which ensures a blister-free contact with the felt, thus assuring a that the fibrous pulp sheet is continuously and reliably guided by the respective felt belt exiting the press slit.

To overcome the above-noted defects and disadvantages, a machine is proposed that includes a suction box. The suction box is positioned along the felt belt and is mounted on the side of the press slit (or nip or gap) where the felt belt exits and the suction box faces away from the fibrous pulp sheet. The suction box is designed to include a suction side to suction the fibrous pulp sheet onto the felt belt. The suction side of the suction box is not porous. The suction box creates a vacuum, which occurs along the felt belt, by blowing air out of the suction box. There may be a vacuum space between the felt belt and the air knife.

Either the suction box or the press arrangement is designed to allow optimal contact between the fibrous pulp sheet and the respective felt belt. Such optimal contact occurs substantially independent of the running speed of the machine and the condition of the felt. Thus, the danger of the fibrous pulp sheet lifting off the felt belt is reduced to a minimum, as is the danger of a sheet run-up during start-up.

In one preferred embodiment, a vacuum is created by air blowing out of at least one slit of the suction box. It is, moreover, useful to have air blown out on at least two, and preferably four, slits of the suction box. Preferably, none of the slits from which the air is blown are located on the suction side of the suction box. Rather, the slit(s) that air may be blown out of are located on the edge of the suction box, the edge being near where two sides of the suction box meet.

In accordance with another aspect of the invention, the suction box may be supplied with pressurized air from a pressurized air source. The pressurized air may be blown through a channel and through openings, such as nozzles, that are located around the rim of the channel. The air then exits the suction box after it passes through the slits or openings located on the edges of the non-suction sides of the suction box. The slits or openings, moreover, assist in sealing the vacuum of the suction box which pulls the fibrous pulp sheet onto the felt belt.

In accordance with one aspect of the invention, the suction box is equipped with a deflector strip. The deflector strip diverts centrifugation water that drains from the circulating press surface. The circulating press surface and an opposing surface form the press slit or opening of the press arrangement. The opposing surface can be, by way of example only, a press roll or something similar. The felt belt and the fibrous pulp sheet are guided over the press slit together.

In accordance with one embodiment of the press arrangement, the press slit is double-felted and the suction box is associated with one of the two felt belts. The felt belt that is associated with the suction box is guided over the suction box simultaneously with the fibrous pulp sheet that adheres to the felt belt. Thus, the fibrous pulp sheet is separated from the other felt belt.

In accordance with another aspect of the invention, the press slit may be formed between a lower circulating press surface and an upper opposing surface. Further, the suction box may be assigned to the lower felt belt, which is guided over the lower press surface.

In accordance with one aspect of the invention, it may be advantageous to create the vacuum, which occurs along the respective side of the felt belt, along the stretch of felt belt that extends over the slit gusset. The slit gusset is formed on the exiting side of the press slit and disposed between the felt belt and the press unit assigned to it. Preferably, the slit gusset extends into the area where the felt belt is removed from the press unit.

Another way to state the invention is a suction box for use in a press arrangement in a machine for producing a fibrous pulp sheet including at least one suction side suctioning the fibrous pulp sheet onto a transport side of at least one felt belt. The suction box further includes at least one non-suction side and at least one slit. The openings or slits are adapted to create the vacuum by having air blown out of the slits. The vacuum occurs in a run direction of the felt belt. The slits are positioned at or near an edge of the non-suction side of the suction box.

Further, the suction box may be disposed on the exit side of the press slit of the press arrangement and further disposed on the non-transport side of the felt belt. The non-transport side of the felt belt is opposite the transport side of the felt belt.

In accordance with one aspect of the present invention, the fibrous pulp sheet is treated in the press slit. Further, the felt belt and the fibrous pulp sheet are simultaneously guided in the run direction through the press slit and exit the press slit on the exit side of the press slit.

In accordance with one aspect of the invention, the fibrous pulp sheet can be either a paper web or a cardboard web.

In accordance with yet another aspect of the invention, the suction box may be supplied with pressurized air from a pressurized air source.

In accordance with another aspect of the invention, the suction box may include a deflector strip that is positioned to divert centrifugation water draining from a circulating press surface. The circulating press surface and an opposing press surface form the press slit of the press arrangement.

In accordance with yet another aspect of the present invention, a vacuum is created along the suction box by air blowing out of at least one slit located on the edge of at least one non-suction side of the suction box. The suction box may include a plurality of non-suction sides. Further, the vacuum may be created by air blowing out of at least two slits or the vacuum may be created by air blowing out of four slits.

According to one embodiment of the invention, the press arrangement of a machine for producing a fibrous pulp sheet includes at least one felt belt. The felt belt includes a transport side to transport the fibrous pulp sheet and a non-transport side. The non-transport side is located on side of the felt belt that is opposite the transport side.

The press arrangement further includes a press slit which is adapted to treat the fibrous pulp sheet. At least one felt belt and the fibrous pulp sheet are simultaneously guided through the press slit in a run direction and exit the press slit on an exit side of the press slit.

In accordance with another aspect of the invention, the press arrangement includes a suction box that includes at least one suction side that suctions the fibrous pulp sheet onto the transport side of at least one felt belt. The suction box further includes at least one slit positioned on an edge of at least one non-suction side of the suction box.

According to another aspect of the invention, the suction box may be disposed on the exit side of the press slit and adjacent the non-transport side of at least one felt belt.

The vacuum occurs in the run direction along at least one felt belt and the fibrous pulp sheet may either be a paper web or a cardboard web.

In accordance with another aspect of the present invention, the suction box may include a plurality of slits and the vacuum may be created by air blowing out at least two slits or by air blowing out of four slits, each slit being positioned on one of the plurality of non-suction sides of the suction box.

In accordance with another aspect of the present invention, the press arrangement may include a pressurized air source coupled to the suction box.

In accordance with yet another aspect of the present invention, the press arrangement may include a deflector strip which diverts centrifugation water that drains from a circulating press surface. The circulating press surface and an opposing surface are positioned to form the press slit.

The press slit may be formed between a lower circulating press surface and an upper opposing surface. Further, the press arrangement may include an upper felt belt and a lower felt belt. The lower felt belt may be guided over the lower press surface and the suction box may be positioned adjacent the lower felt belt.

In accordance with another aspect of the invention, the press arrangement may include a first and a second felt belt, which, along with the fibrous pulp sheet, are simultaneously guided over at least a portion of the suction box.

In accordance with yet another aspect of the present invention, the suction box may be adapted to separate the second felt belt from the first felt belt and the fibrous pulp sheet. The first felt belt may guide the fibrous pulp sheet to a transfer station.

In accordance with yet another aspect of the invention, the press arrangement may include a deflector roll positioned adjacent the second felt belt and the second felt belt may be guided over the deflector roll.

The press arrangement may further include a vacuum that extends in the run direction along at least one felt belt. The vacuum extends from a slit gusset, which is disposed on the exit side of the press slit adjacent the non-transport side at least one felt belt and adjacent the press unit assigned to at least one felt belt. The vacuum extends in the run direction to the end of the suction box.

In accordance with another aspect of the present invention, the vacuum may extend into a removal region where at least one felt belt may be removed from the press unit assigned to that felt belt.

In accordance with another aspect of the invention, the press arrangement may include an upper press unit and a lower press unit. The upper press unit and the lower press unit are adapted to form the press slit.

In accordance with another aspect of the invention, the press arrangement may include a first and a second felt belt. The first felt belt is designed to transport the fibrous pulp sheet over the lower press unit and the second felt belt is positioned above the fibrous pulp sheet.

The first and second felt belts and the fibrous pulp sheet are simultaneously guided in the run direction through the press slit.

In accordance with another aspect of the invention, the suction box is positioned on the exit side of the press slit adjacent the first felt belt.

The press arrangement may further include a deflection roll positioned above the suction box to separate the second felt belt from the fibrous pulp sheet after the first and second felt belts and the fibrous pulp sheet have traveled over at least a portion of the suction box. The suction box may also be disposed opposite the deflection roll over which the second felt belt is guided.

Another way of stating the present invention is a suction box for use in a machine for producing a fibrous pulp sheet including at least one suction side to suction the fibrous pulp sheet onto at least one belt and at least one non-suction side. The suction box may also include at least one slit blowing air out of the suction box to create a vacuum. The vacuum occurs in a run direction of the belt.

In accordance with another aspect of the invention, the fibrous pulp sheet may either be a paper web or a cardboard web and the belt may be a felt belt.

In accordance with one aspect of the invention, at least one slit may be positioned adjacent an edge of at least one of the non-suction sides of the suction box. Further, the suction box may include a plurality of slits and the vacuum may be created by air blowing out of at least two of the plurality of slits or four of the plurality of slits.

In accordance with another aspect of the invention, the suction box may be adapted for use in combination with a press arrangement of the machine for producing a fibrous pulp sheet. The press arrangement may include a first press unit and a second press unit that form a press opening. The press opening is adapted to treat the fibrous pulp sheet.

The press arrangement may further include an upper belt and a lower belt, with the upper and lower belts sandwiching the fibrous pulp sheet while they are simultaneously guided through the press opening and over at least a portion of the suction box.

The press arrangement may further include a deflector roll positioned opposite the suction box adjacent the upper belt and the suction box may be positioned so that it suctions the lower belt and the fibrous pulp sheet while the upper belt is guided over the deflector roll.

In accordance with one aspect of the invention, the suction box may include a deflector strip adapted to divert centrifugation water draining from a circulating press surface. The circulating press surface and an opposing press surface form a press slit of a press arrangement.

It is understood that the features discussed above and below may be used, not only in the combinations given, but also in other combinations or alone, without departing from the scope of the invention. Moreover, other useful embodiments and advantages of the present invention may be ascertained by reviewing the present disclosure and the accompanying drawings.

BRIEF DESCRIPTION OF THE DRAWINGS

The invention will be better understood by referring to the description which follows with reference to the drawing, which illustrates by way of non-limiting example, embodiments of the invention, wherein.

DETAILED DESCRIPTION OF THE DRAWINGS

Figure 1:
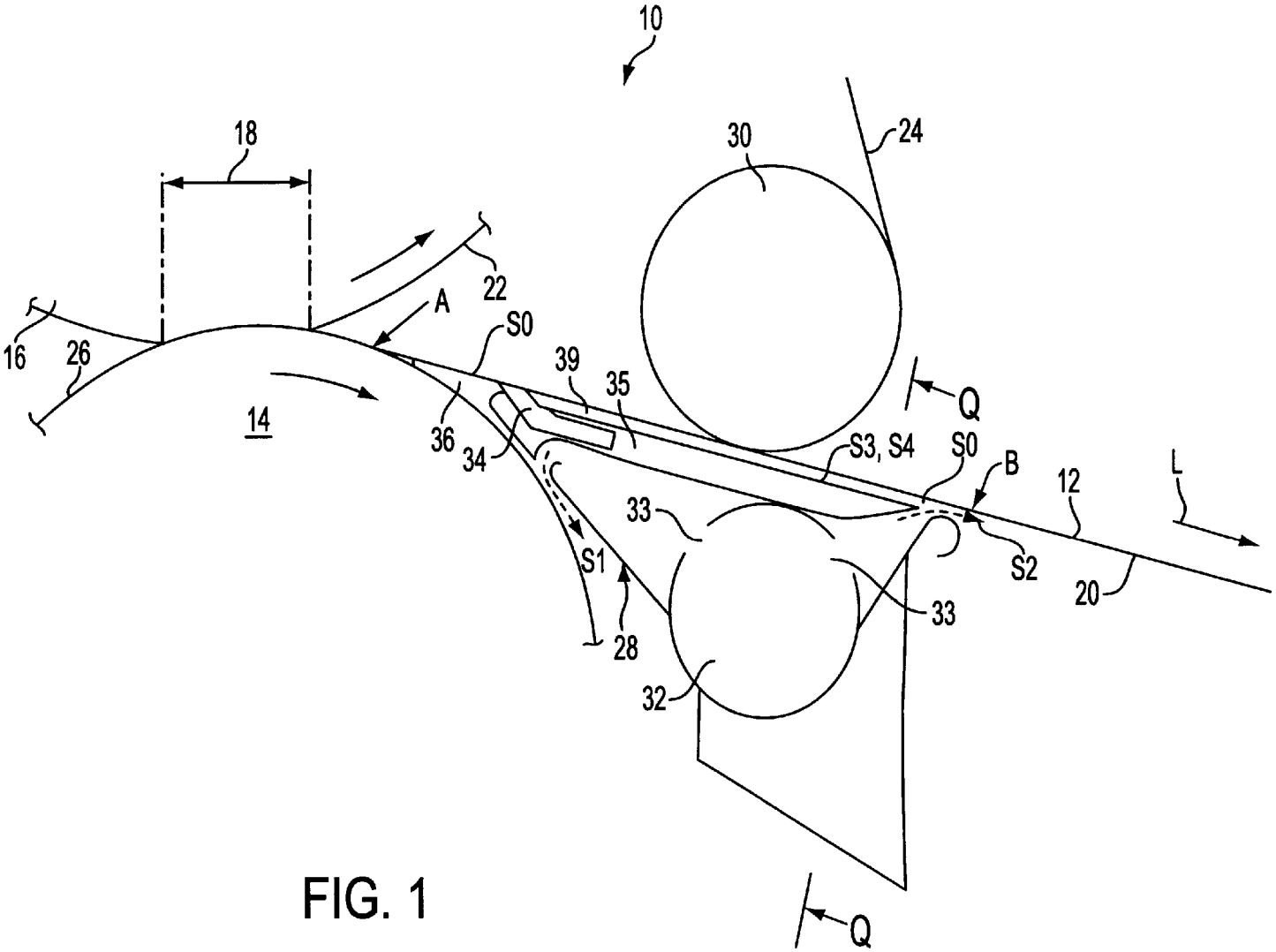
FIG. 1 illustrates a schematic diagram of the side view of part of a press arrangement equipped with a suction box.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figures making apparent to those skilled in the art how the invention may be embodied in practice.

FIG. 1 illustrates a schematic diagram of a press arrangement 10 of a machine for producing a paper or cardboard web. The press arrangement 10 includes a press slit (or gap or nip) 18, that is formed between the lower press roll 14 and the upper press unit 16. In the present case, the press slit 18 extends in a run direction L of a fibrous pulp sheet 12.

In addition to the fibrous pulp sheet 12, a lower felt belt 20, which is guided over the press roll 14, and an upper felt belt 24, which is guided over the opposing surface 22 formed by the press unit 16, are guided through the press slit (gap or nip) 18. The fibrous pulp sheet 12 is treated in the press slit 18. The press slit 18 is formed by the press surface 26 of the lower press roll 14 and the opposing surface 22 of the upper press unit 16. The fibrous pulp sheet 12 rests between the lower felt belt 20 and the upper felt belt 24.

In one embodiment of the present invention, the upper press unit 16 can, for example, be a conventional shoe press unit.

As the lower felt belt 20 exits the press slit 18, the lower felt belt 20 is guided diagonally downwards over the suction box 28. As the upper felt belt 24 exits the press slit 18, the upper felt belt 24 is first guided diagonally downwards, but then, the upper felt belt 24 is guided over a deflection roll 30, which guides the felt belt 24 diagonally upwards.

As the fibrous pulp sheet 12 exits the press slit 18, the fibrous pulp sheet 12 runs together with the lower felt belt 20. The suction box 28 is positioned on the lower side (i.e., the side opposite the fibrous pulp sheet 12) of the lower felt belt 20. The upper side of the lower felt belt 20 carries the fibrous pulp sheet 12. Thus, the fibrous pulp sheet 12 is, in general, suctioned downward onto the lower felt belt 20.

In accordance with one aspect of the invention, at least one side of the suction box 28, which extends along the lower felt belt 20, is designed as the suction side SO. The suction side SO of the suction box 28 is constructed of nonporous material. The vacuum is created by air being blown out of the suction box 28 through at least one slit or opening (S1, S2, S3, S4), thereby creating a vacuum which draws the fibrous pulp sheet 12 onto the lower felt belt 20. The air passes through the lower felt belt 20 into the vacuum space 39, which is a low pressure area located between the lower felt belt 20 and the air knife 35. The air space 39 is maintained due to felt belt 20 tension. The air space 39 may be approximately 25 millimeters.

In accordance with the present invention, the vacuum that occurs along the felt belt 20 is created by having air blown out of at least one slit or opening (S1, S2, S3, S4) of the suction box 28. As FIG. 1 shows, the slits (S1, S2, S3, S4) are located on the edges of the sides of the suction box. Preferably, the sides of the suction box on which the slits (S1, S2, S3, S4) are located are different from the suction side SO.

The suction box 28 is supplied with pressurized air through a channel 32. Channel 32 may be connected to a pressurized air source (not shown in FIG. 1). The air is blown into the channel 32 and into the openings or nozzles 33 of the channel 32 which lead to the slits (S1, S2, S3, S4). The air exits the suction box 28 through one or more of the slits (SI, S2, S3, S4) of the suction box 28. The slits (S1, S2, S3, S4) further assist in sealing the vacuum of the suction box 28 which pulls the fibrous pulp sheet 12 onto the lower felt belt 20.

The dashed lines in FIG. 1 indicate the path the air takes as the air is blown out of the suction box 28. Slits S3 and S4 of the suction box 28 represent openings in the side edges of the suction box 28 that project perpendicularly into and out from the plane of FIG. 1. Slits S3 and S4 are more clearly depicted in FIG. 2.

Figure 2:
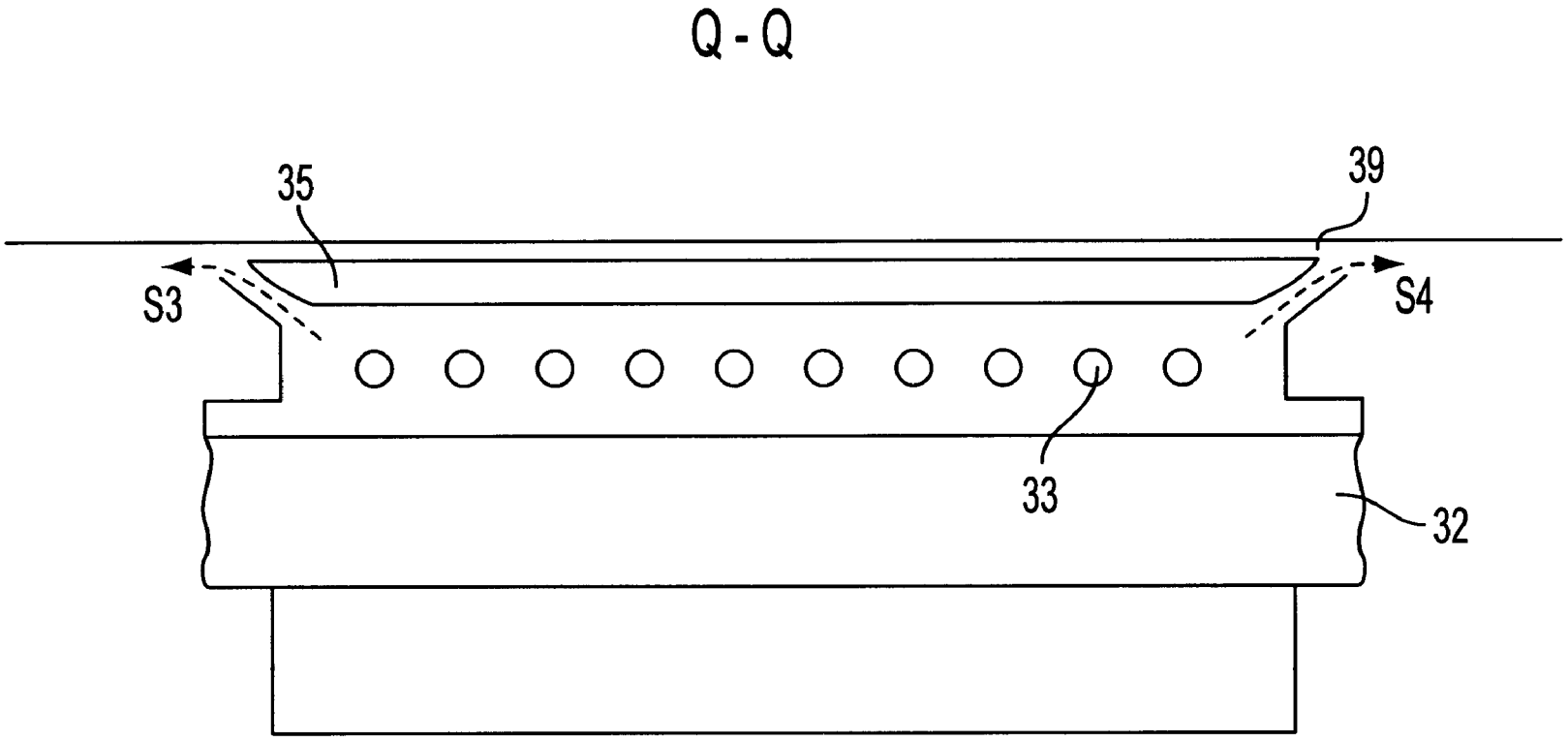
FIG. 2 is a schematic diagram of a cross-section of the suction box.

FIG. 2 represents a cross section of the suction box. The dashed lines and arrows in FIG. 2 represent the path the air takes as the air is blown out of the suction box 28. As FIG. 2 shows, the air exits the suction box 28 via slits (S3, S4). FIG. 2 also illustrates the air knife 35 and the vacuum space 39.

As shown in FIG. 1, the suction box 28 may also be equipped with a deflector strip 34.

The deflector strip 34 diverts the centrifugation water that comes from the lower press roll 14 downward. Moreover, the suction box 28 is positioned opposite the deflection roll 30, over which the upper felt belt 24 is guided.

As can be seen in FIG. 1, the vacuum that occurs below the lower felt belt 20 is created along the stretch A–B, which runs along the felt belt 20. The stretch A–B may reach into the slit gusset 36. The slit gusset 36 is formed on the discharge or exit side of the press slit 18 between the lower felt belt 20 and the press unit assigned to it, namely press roll 14. Preferably, the slit gusset 36 extends into the area where the felt belt 20 is removed from the press roll 14.

Thus, as shown in FIG. 1, the press arrangement 10 includes a double-felt press with a suction box 28 associated with it. Here, the suction box 28 is assigned to or coupled with the lower felt belt 20. The felt belt 20, with the fibrous pulp sheet 12 adhering thereto, is guided over the suction box 28 which serves to separate the fibrous pulp sheet 12 from the upper felt belt 24.

After the lower felt belt 20, with the fibrous pulp sheet 12 adhering to it, is guided over the suction box 28, and after the fibrous pulp sheet 12 is separated from the upper felt belt 24, the lower felt belt 20 is guided to a transfer station (not shown in FIG. 1). Finally, from the transfer station, the fibrous pulp sheet 12 may be guided to another press slit, which is also not shown in FIG. 1.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above.

Various changes can be made therein without departing from the spirit and scope of the invention.

What is claimed is:

1. A suction box in combination with and for use in a press arrangement in a machine for producing a fibrous pulp sheet comprising:

at least one suction side suctioning the fibrous pulp sheet onto a transport side of at least one felt belt;

at least one non-suction side;

at least one slit blowing air out of the suction box creating a vacuum, said vacuum occurring in a run direction of said at least one felt belt;

said at least one slit positioned at an edge of at least one non-suction side of the suction box;

the suction box being disposed on an exit side of a press nip of the press arrangement and on a side of said at least one felt belt being opposite said transport side;

the fibrous pulp sheet being treated in said press nip;

said at least one felt belt and the fibrous pulp sheet being simultaneously guided in said run direction through said press nip and exiting said press nip on said exit side of said press nip; and a deflector strip mounted on the at least one suction side of the suction box and structured and arranged to contact the felt belt, said deflector strip being positioned to divert centrifugation water draining from a circulating press surface, wherein said circulating press surface and an opposing press surface are positioned to form said press nip of said press arrangement.

2. The machine according to claim 1 the fibrous pulp sheet being a paper web.

3. The machine according to claim 1 the fibrous pulp sheet being a cardboard web.

4. The suction box according to claim 1 further comprising a pressurized air source supplying pressurized air.

5. The suction box according to claim 1 said vacuum being created by air blowing out of said at least one slit of the suction box, said at least one slit comprising a plurality of slits.

6. The suction box according to claim 5 said vacuum being created by air blowing out of two of said plurality of slits of the suction box.

7. The suction box according to claim 5 said vacuum being created by air blowing out of four of said plurality of slits of the suction box.

8. A press arrangement of a machine for producing a fibrous pulp sheet comprising:

at least one felt belt including a transport side transporting the fibrous pulp sheet and a non-transport side on an opposite side of said at least one felt belt from said transport side;

a press nip adapted to treat the fibrous pulp sheet, said at least one felt belt and the fibrous pulp sheet being simultaneously guided through said press nip in a run direction and exiting said press nip on an exit side of said press nip;

a suction box including at least one suction side suctioning the fibrous pulp sheet onto said transport side of said at least one felt belt and at least one slit creating a vacuum by blowing air out of said at least one slit, said at least one slit positioned on an edge of at least one non-suction side of said suction box;

said suction box being disposed on said exit side of said press nip and adjacent said non-transport side of said at least one felt belt;

said vacuum occurring in said run direction along said at least one felt belt; and a deflector strip mounted on the at least one suction side of the suction box and structured and arranged to contact thc felt belt, said deflector strip diverting centrifugation water draining from a circulating press surface, wherein said circulating press surface and an opposing surface are positioned to form said press nip.

9. The machine according to claim 8 the fibrous pulp sheet being a paper web.

10. The machine according to claim 8 the fibrous pulp sheet being a cardboard web.

11. The press arrangement according to claim 8 said at least one slit comprising a plurality of slits.

12. The press arrangement according to claim 11 said vacuum being created by air blowing out of at least two of said plurality of slits.

13. The press arrangement according to claim 11 said vacuum being created by air blowing out of four of said plurality of slits.

14. The press arrangement according to claim 8 further comprising a pressurized air source coupled to said suction box.

15. The press arrangement according to claim 8 wherein said at least one felt belt comprising an upper felt belt and a lower felt belt, said lower felt belt being guided over said lower press surface and said suction box positioned adjacent said lower felt belt.

16. The press arrangement according to claim 8 said at least one felt belt comprising a first and a second felt belt, said first and second felt belts and the fibrous pulp sheet being simultaneously guided over at least a portion of said suction box;

said suction box adapted to separate said second felt belt from said first felt belt and the fibrous pulp sheet; and said first felt belt guiding the fibrous pulp sheet to a transfer station.

17. The press arrangement according to claim 16 further comprising a deflector roll positioned adjacent said second felt belt; and said second felt belt being guided over said deflector roll.

18. The press arrangement according to claim 8 said vacuum extending in said run direction along said at least one felt belt from a slit gusset disposed on said exit side of said press nip adjacent said non-transport side of said at least one felt belt and adjacent a press unit assigned to said at least one said felt belt, said vacuum extending in said run direction to an end of said suction box.

19. The press arrangement according to claim 18 said vacuum extending into a removal region wherein said at least one felt belt is removed from said press unit assigned to said at least one felt belt.

20. The press arrangement according to claim 8 further comprising:

an upper press unit;

a lower press unit, said upper press unit and said lower press unit being adapted to form said press nip;

said at least one felt belt comprising a first and second felt belt, said first felt belt being designed to transport the fibrous pulp sheet over said lower press unit and said second felt belt being positioned above the fibrous pulp sheet;

said first and second felt belts and the fibrous pulp sheet being simultaneously guided in said run direction through said press nip;

said suction box positioned on said exit side of said press nip adjacent said first felt belt;

further comprising a deflection roll positioned above said suction box to separate said second felt belt from the fibrous pulp sheet after said first and second felt belts and the fibrous pulp sheet travel over at least a portion of said suction box.

21. The press arrangement according to claim 20 said suction box being disposed opposite said deflection roll over which said second felt belt is guided.

22. A suction box for use in a machine for producing a fibrous pulp sheet comprising:

at least one Suction side suctioning the fibrous pulp sheet onto at least one belt;

at least one non-suction side;

at least one slit blowing air out of the suction box creating a vacuum, said vacuum occurring in a run direction of said at least one belt; and a deflector strip mounted on the at least one suction side of the Suction box and structured and arranged to contact the at least one belt, said deflector strip being adapted to divert centrifugation water draining from a circulating press surface, wherein said circulating press surface and an opposing press surface are arranged to form a press nip of a press arrangement.

23. The machine according to claim 22 the fibrous pulp sheet being a paper web.

24. The machine according to claim 22 he fibrous pulp sheet being a cardboard web.

25. The suction box according to claim 22 said at least one slit positioned adjacent an edge of said at least one non-suction side of the suction box.

26. The suction box according to claim 22 said at least one slit comprising a plurality of slits.

27. The suction box according to claim 24 said vacuum being created by air blowing out of at least two of said plurality of slits.

28. The suction box according to claim 24 said vacuum being created by air blowing out of four of said plurality of slits.

29. The Suction box according to claim 22 in combination with the press arrangement of the machine.

30. The suction box according to claim 29 said press arrangement comprising:

a first press unit and a second press unit forming a press opening adapted to treat the fibrous pulp sheet;

said belt comprising an upper belt and a lower belt;

said upper belt and said lower belt sandwiching the fibrous pulp sheet while being simultaneously guided through said press opening and over at least a portion of the suction box;

a deflector roll positioned opposite the suction box adjacent said upper belt, said upper belt being guided over said deflector roll;

the suction box being positioned to suction said lower belt and the fibrous pulp sheet while said upper belt is guided over said deflector roll.

* * * * *